US005651549A

United States Patent [19]

Dill et al.

[11] Patent Number: 5,651,549

[45] Date of Patent: Jul. 29, 1997

[54] LACROSSE STICK AND HEAD FRAME THEREFOR

[75] Inventors: James T. Dill, Rockport, Me.; William H. Brine, III, Hopkinton, Mass.

[73] Assignee: Sports Licensing, Inc., Hanover, N.H.

[21] Appl. No.: 567,600

[22] Filed: Dec. 5, 1995

[51] Int. Cl.[6] ..... A63B 59/02

[52] U.S. Cl. ..... 473/513

[58] Field of Search ..... 273/326

[56] References Cited

U.S. PATENT DOCUMENTS 5,037,112 8/1991 Brine, III et al. ..... 273/326

*Primary Examiner*—William H. Grieb

*Attorney, Agent, or Firm*—Barry R. Blaker

[57] ABSTRACT

Disclosed herein is a lacrosse stick construction and a head frame therefor having improved playability characteristics. The lacrosse stick involves a specified relationship between the plane defined by the uppermost surface of the stick element, taken at its forward end, relative to the location of the center of gravity of the head.

11 Claims, 2 Drawing Sheets

LACROSSE STICK AND HEAD FRAME THEREFOR

BACKGROUND OF THE INVENTION

The present invention relates generally to a lacrosse stick construction and is more particularly concerned with a novel lacrosse stick construction whereby improved playability and other functional benefits are realized.

The game of lacrosse is generally considered as the oldest team contact sport of North American origin. Historical evidence suggests that the game of lacrosse was played by various Indian tribes, such as the Iroguois and Hurons, as early in time as the 15th century. It is generally accepted that the original purpose of the sport of lacrosse was to physically and/or psychologically condition Indian warriors preparatory to actual combat or, in some instances, to itself function as a game forum for the settlement of tribal differences. While the equipment utilized in the sport of lacrosse has, of course, evolved substantially over the years, one all-important piece of equipment whose basic constructional characteristics have remained constant is the lacrosse stick or "crosse". In this, the lacrosse stick over the years since the inception of the sport has comprised an elongate stick having a butt end and a forward end and, coaxially and integral with or fixedly attached to the forward end of said stick, a head frame comprising at least one side wall element extending forwardly of the forward end of the stick and in a laterally divergent manner from the center line thereof and a nose element extending transversely across the forward end(s) of said side wall element(s), said nose element traversing the forwardly extended center line of said stick. The upper rim of said head frame defines an open mouth wherethrough the lacrosse ball is received into and shot, passed or checked from the lacrosse stick. In plan view the head frame defines a generally isosceles triangular area extending coaxially and forwardly of the forward end of the stick. Said triangular area is broadly divisible into two functional portions: a rear or throat portion adjacent the juncture of the side wall(s) with the forward end of the stick and, forwardly of said throat portion, a receiving/shooting portion extending forwardly to the transverse nose element. Generally, the rear portion of the head frame is also arcuately formed, the radius of curvature of said rear portion being selected such that it defines an accomodating surface against which the lacrosse ball usually rests while retained in the throat portion of the head frame. Suspended from the lower rim of the head frame is a netting defining a bottom closure of the frame. That portion of the netting suspended from the forward zone of the head frame defines a ball reception and shooting zone into which the lacrosse ball is initially received and entrapped by the player and from which the ball is ultimately passed or shot. The rearward portion of the netting, in other words, that portion thereof suspended from the throat of the head frame and which usually includes a pocket, defines a zone within which the lacrosse ball resides during the player's retention thereof in the lacross stick.

With the decreasing availability of high grade ash or hickory wood, decreasing availability of the woodworking skills necessary to form and fabricate lacrosse sticks having integral one-piece wooden stick/head frame constructions and in further view of the labor intensive nature of the fabrication of such integral one-piece wooden stick/head frame constructions it has become commonplace to fabricate lacrosse sticks using a straight stick element formed of straight grained wood or wood laminate or a tough, lightweight metallic or reinforced plastic tubular element such as in the nature of a thin gauge metallic extrusion or a fiber reinforced composite plastic material and to affix to the forward end of the stick a separate, bilaterally symmetrical head frame composed of a tough synthetic thermoplastic material, such as a high impact strength nylon material prepared and/or sold under the trademark, ZYTEL, by DuPont de Nemours & Company, Inc., Wilmington, Del. In such modern versions of a lacrosse stick the head frame comprises a rearwardly oriented coaxial socket element to receive the forward end of the stick therein, a pair of laterally divergent side wall elements extending forwardly of said socket element and a transversely oriented nose element bridging the forward ends of said pair of side wall elements. The apex of the angle defined between said divergently oriented side wall members is truncated by means of a rearwardly directed arcuate wall element bridging said side wall members and defining a ball stop. The transverse nose element is, desirably, canted forwardly at an upwardly positive angle so as to define a scoop-shaped lip member which facilitates the player's ability to receive a ground-borne lacrosse ball thereover.

During the course of play the lacrosse ball may be received into the lacrosse stick in one or the other of the following manners: (a) a ground-borne ball may be received over the upper rim of the head frame, particularly the forward edge of the nose element, or (b) an air-borne lacrosse ball, whether by pass or by bouncing upwardly off the ground, may be initially received through the upper rim of the head frame in the forward reception/shooting zone thereof and arrested from flight by the underlying netting suspended from the lower edge of the frame element. In the reception of a ground-borne ball it is necessary that the player crouch, bend or lean to a greater or lesser extent in order to successfully engage the nose element of the head frame of the stick with the ground and/or ball. Generally speaking, the greater the angle of crouch or bend required of a player to receive a ground-borne ball, the greater the effort and skill required to successfully receive the ball. Whatever the mode of reception, however, it is usually the case that the player, once the ball has been initially received into the forward portion of the head frame, then rolls the ball rearwardly along the netting until its motion is arrested by the ball stop. Thereafter, the ball is carried in the pocket of the netting underlying the throat of the head frame member until checked from the player's stick or intentionally passed or shot therefrom. During possession of the ball the player will often spin the stick rapidly about its longitudinal axis, thereby to impart centrifugal force to the ball and to thereby aid the player in cradling the ball within the pocket of the stick. During the player's ground maneuvering while cradling the ball in the stick it is a further desideratum of the sport that the stick shaft be held close to the player's body. However, in accordance with N.C.A.A. rules of the sport, the head frame of the stick must not be held so closely to the body as to block the opening defined by the upper rim of the head frame. In passing or shooting of the lacrosse ball, the ball is initially rolled forwardly from its pocket within the throat of the frame and leaves said netting or webbing from the forwardly located receiving/shooting zone of the head frame whereat maximum velocity tends to be generated in the passing or shooting stroke.

One problem generally found in lacrosse sticks and particularly with respect to modern lacrosse sticks comprising a molded thermoplastic head frame, resides in a lack of ability of a player to sense, by feel alone, the rotational orientation of the head. Thus, in order to assure that the head of the stick is properly rotationally oriented to receive a ball, in other words, that the upper open rim of the head frame is facing the incoming ball, it is generally necessary that the player first visually observe the head and then properly adjust the stick and its head's rotational orientation on the basis of such visual observation. This need for visual observation of the stick's head preparatory to receiving the ball at least momentarily distracts the player from observing the field of play and the ball and thus reduces his or her playing efficiency. On the other hand, if, in the player's zeal to continuously view the field of play and the ball, he or she fails to make this preliminary visual observation of the stick head and, instead, relies entirely upon tactile sensing of the rotational orientation of the head frame, the player may easily attempt to receive the ball into the bottom rim of the head frame which, of course, is closed by the netting suspended therefrom. In accordance with the present invention, this problem has been successfully addressed.

OBJECTS OF THE INVENTION

It is a principal object of the invention to provide a new and novel lacrosse stick construction.

It is another object of the invention to provide a novel lacrosse stick construction whereby the player is provided with improved tactile sensing of the rotational orientation of the head frame thereof.

It is yet another object of the invention to provide a lacrosse stick construction whereby reception of ground-borne lacrosse balls is facilitated.

It is still another object of the invention to provide a novel lacrosse stick construction whereby, in ground maneuvering of the player while cradling of the lacrosse ball, the head frame thereof may be carried more closely to the body of the player than is possible with lacrosse stick constructions of the prior art.

It is yet another object of the invention to provide a new and novel lacrosse stick head frame wherein, in a lacrosse stick bearing said head frame construction, the foregoing playability benefits, severally or in combination, are realized.

Other objects and advantages of the present invention will, in part, be obvious and will, in part, appear hereinafter.

SUMMARY OF THE INVENTION

In accordance with the invention there is provided a lacrosse stick construction comprising an elongate stick element defining a handle, said stick element having a rear butt end and a forward end and said stick element further having a longitudinal center line and an upper surface which, at its forward end, defines a plane lying parallel to and spaced above said center line. A head is coaxially affixed to the forward end of said stick element, said head comprising a head frame having at least one side wall extending forwardly and laterally divergently from the center line of said stick element and a nose element attached to the forward end of each said side wall and traversing said center line. Said head frame has upper and lower rims, the upper rim defining the open mouth of the head and the lower rim having a netting suspended therefrom, said netting defining a bottom closure of the head frame. In accordance with the invention means are provided whereby the center of gravity of the head, and preferably that of the head frame, taken alone, lies at an effective distance below the plane defined by the uppermost surface of said stick element at its forward end. By this depending location of the center of gravity, which is preferably below the center line of the stick element, there results a lacrosse stick construction wherein the head of the stick is provided with sufficient rotational imbalance as to enable the player to sense orientation of the head frame by the tactile stimuli generated by the head acting through the stick element.

In another aspect of the invention at least the principal means by which the center of gravity of the head is located below the plane defined by the upper surface of the stick element comprises an acute depending step along the length of at least one side wall of the head frame, said step preferably being located rearwardly of the mid-length of said side wall and most preferably being located at the rear of the throat of the head frame.

DESCRIPTION OF PREFERRED EMBODIMENTS

Figure 1:
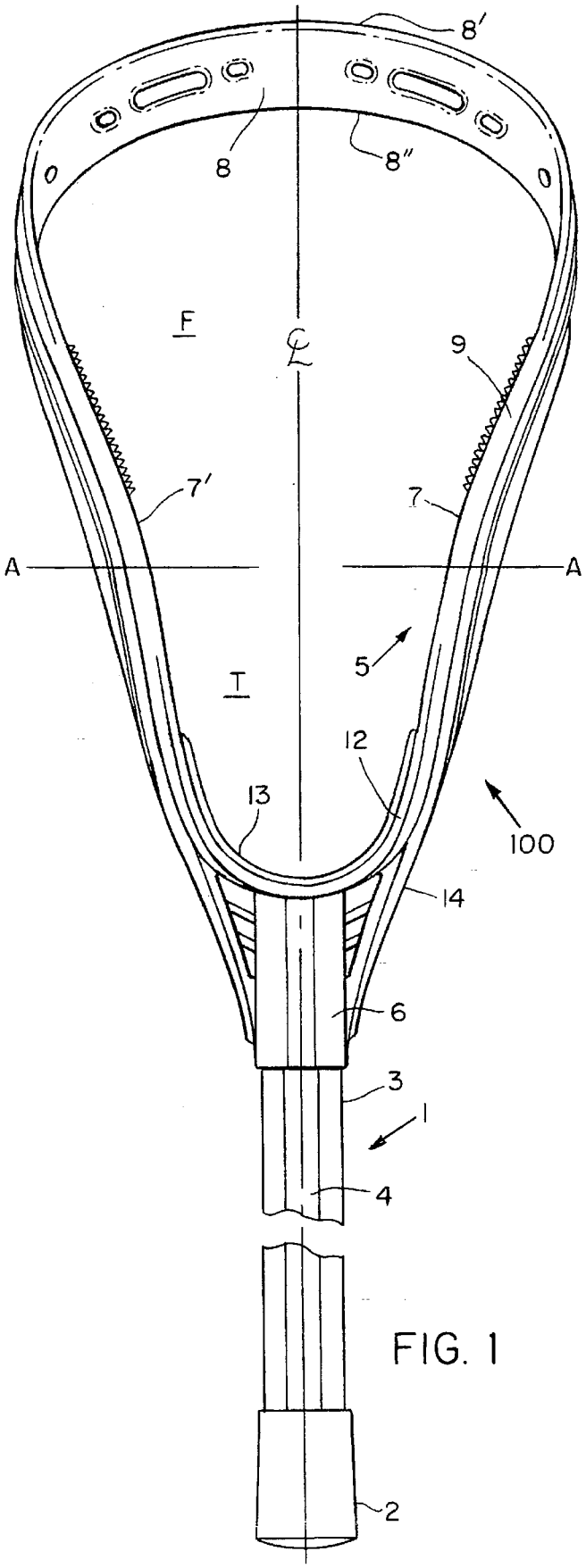
FIG. 1 hereof is a diagrammatic top plan view of the of a lacrosse stick in accordance with a preferred embodiment of the invention.
Figure 2:
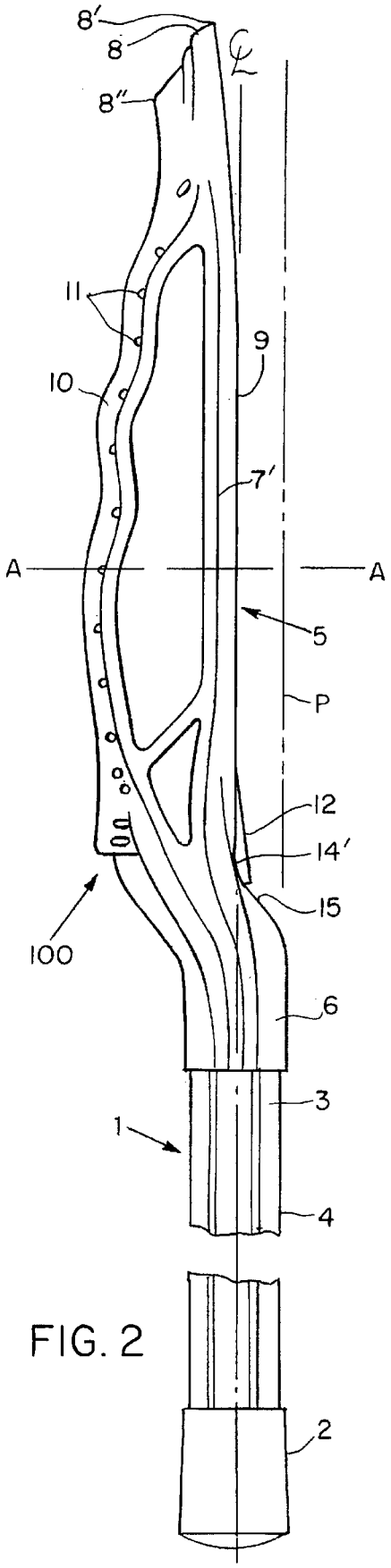
FIG. 2 hereof is a diagrammatic left side view of the embodiment of invention shown in FIG. 1.
Figure 3:
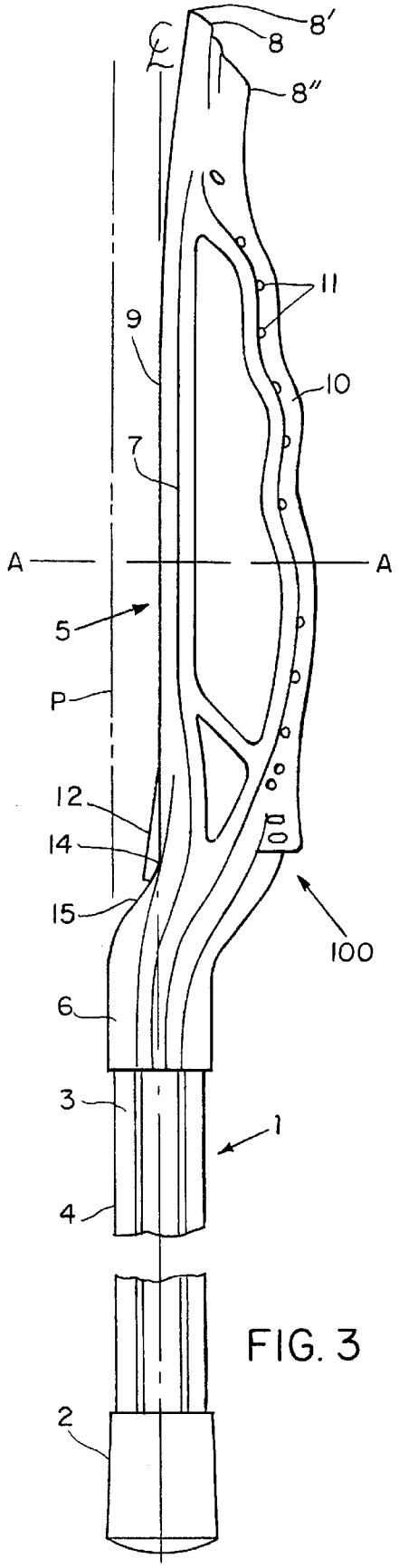
FIG. 3 hereof is a diagrammatic right side view of the embodiment of the invention shown in FIGS. 1 and 2.

Referring now to FIGS. 1 through 3 hereof, wherein like reference numerals refer to like structures and wherein there is depicted a lacrosse stick of the type comprising a stick element and a separate molded thermoplastic head frame affixed thereto, the lacrosse stick construction of the invention broadly comprises an elongate stick element 1 defining a handle and having a rearward butt end 2 and a forward end 3, said stick element 1 having a longitudinal center line $C_L$ and an uppermost surface 4 which, taken at the forward end 3, defines a plane P which lies parallel to and spaced above the center line $C_L$. Coaxially affixed to the forward end 3 of stick element 1 is a head 100 comprising a head frame 5 having a rearwardly facing coaxial socket 6 to receive the forward end 3 of stick element 1 therein, a pair of side walls 7, 7' extending forwardly of said socket 6 in a symmetrical and laterally divergent manner from the center line $C_L$ and a nose element 8 which bridges the forward ends of side walls 7, 7' and which thereby traverses the center line $C_L$. It will be appreciated, of course, that the plane P and the center line $C_L$ can also be determined by reference to the interior of the socket 6. As may be best seen in the top plan view of FIG. 1, the nose element 8 is desirably canted forwardly such that the upper edge 8' thereof is located forwardly of its bottom edge 8". Thus, the nose element 8 defines a scoop shaped structure over which the reception of a ground ball is facilitated. At the rear of the head frame 5 and truncating the angle defined between the divergent side walls 7, 7' thereof is a rearwardly directed arcuate wall 12 whose radius of curvature is sufficient as to define a stop for the lacrosse ball. Typically, the interior surface of said arcuate wall 12 is lined with a soft, resilient padding 13. Said head frame 5 thus defines within its boundaries an interior area of generally isosceles triangular geometry. Said area is broadly divisible, such as shown by the construction line A–A', into a forward zone F wherein the lacrosse ball is received and passed or shot and a rearward throat section T wherein the lacrosse ball resides during a player's possession thereof. In addition, said head frame 5 comprises an upper rim 9 defining the open mouth of the stick and a lower rim 10 having a plurality of apertures 11 spaced about the periphery thereof. In completion of the head 100 the usual netting, which for purposes of clarity is not shown in the drawing, is affixed to and suspended from the lower rim 10 by means of said apertures 11, thereby to define a bottom closure of the head frame 5.

In accordance with the invention the head 100 or, preferably, the head frame 5 itself, is provided with means by which the center of gravity of the head 100 is located at an effective distance below the plane P. For purposes of the present invention, "effective distance" means that the center of gravity of the head 100 is sufficiently below said plane P as to enable the player using the lacrosse stick of the invention to sense the orientation of the head 100 by the feel of the lacrosse stick in the player's hands. Due, in part, to the wide range of tactile sensitivities exhibited amongst humans and, in part, to the many types and constructions of the various protective gloves worn in the-practice of the sport it is not possible to quantify, with specificity, a minimum required displacement of the center of gravity of the head 100 below the plane P. However, it can be said that the tactile sense benefit of the invention is generally attained when the center of gravity of the head 100 lies at or below the center line $C_L$ of the stick element 1.

Various means for controlling the center of gravity of the head 100 may be utilized. For instance, weights may be attached to or molded into the lower rim 10. Alternatively, the netting suspended from the lower rim 10, which netting defines the bottom closure of the head frame 5, may be constructed of a weighted cord material such as, for instance, a braided polyester lead core fishing line. Each of these expedients, however, obviously adds at least some weight to the overall head 100 construction and it is usually preferable that control of the center of gravity of the head 100 be achieved in the design of the head frame 5 rather than by the addition of weight thereto. In accordance with the preferred embodiment of the invention depicted in FIGS. 1 through 3 the tactile sensing benefit along with additional functional benefits are provided by abruptly lowering from the plane P at least one sidewall 7 or 7' along the length thereof to define an acutely depending step 14 or 14' therein. Preferably, where the head frame 5 is of molded thermoplastic construction and comprises a pair of side walls 7 and 7', both said side walls will comprise said steps 14, 14' in a bilaterally symmetrical manner. Further, while the steps 14, 14' may be located at substantially any point along the lengths of the side walls, it is preferred that they be located rearwardly of the division between the forward zone F and throat zone T, as indicated by the construction line A–A'and, of even greater preference, will be located rearwardly of the arcuate wall 12, thereby to lower substantially the entire mass of that portion of head frame 5 from which the netting is suspended to below the plane P. In a head frame of molded thermoplastic construction and as is shown in FIGS. 1 through 3 this last can be accomplished by molding the thermoplastic material intermediate the socket 6 and the arcuate wall 12 with a depending bend 15 therein. Thus, substantially the entire portion of the head frame 5 forward of the socket 6 is eccentrically and dependingly mounted to the stick element 1. As can be best appreciated by reference to the side views of FIGS. 2 and 3, by locating the entire upper rim 9 of the head frame 5 at a spaced distance below the plane P it is apparent that the player utilizing the lacrosse stick of the invention need not bend or lean over to as great an extent to capture ground balls as compared to prior art lacrosse sticks of equal length wherein the upper rim of the head frame is at or above the plane P. It is further apparent that in cradling of a lacrosse ball during ground maneuvering, the player using the lacrosse stick of the present invention can hold the stick more closely to his body and without fear of illegal blocking of the opening of the head 100.

It is to be understood that the present invention is not to be limited to the particular construction disclosed hereinbefore and/or shown in the drawings, but also comprises any modifications or equivalents thereof within the scope of the appended claims.

What is claimed is:

1. A lacrosse stick construction comprising:

(A) an elongate stick element having a rear butt end and a forward end, said stick element having a longitudinal center line and an uppermost surface at its forward end defining a plane lying parallel to and spaced above said center line;

(B) a lacrosse head coaxially affixed to the forward end of said stick element of (A), said lacrosse head comprising a head frame comprising at least one side wall extending forwardly and laterally divergently from said center line and a nose element attached to the forward end of each said side wall, said nose element traversing said center line, said head frame having upper and lower rims, said upper rim defining the open mouth of said head and said lower rim having a netting suspended therefrom to define a bottom closure of said head frame, and (C) means to cause the center of gravity of said head to lie at an effective distance below said plane whereby a player is enabled to sense orientation of said head frame through the tactile stimuli generated by said head acting through said stick element, said means comprising said at least one said side wall being abruptly lowered to a spaced distance below said plane, said lowering being located along the length thereof and whereby an acutely depending step is defined therein.

2. The lacrosse stick construction of claim 1 wherein the center of gravity of said lacrosse head lies at or below said center line of said stick element.

3. The lacrosse stick construction of claim 1 wherein said abrupt lowering of said at least one side wall is located rearwardly of the mid-length thereof.

4. The lacrosse stick construction of claim 1 wherein said head frame comprises a pair of side walls extending forwardly and divergently from said center line, the angle defined between said side walls being truncated by a rearwardly directed arcuate wall defining a ball stop, and wherein each of said pair of side walls comprises said abrupt lowering thereof at a common location along the lengths thereof, thereby to define bilaterally symmetrical acutely depending steps therein.

5. The lacrosse stick construction of claim 4 wherein said abrupt lowering of said side walls is located rearwardly of said arcuate wall defining said ball stop.

6. A head frame for a lacrosse stick, said head frame being of a molded thermoplastic material and comprising:

(A) a rearwardly facing socket element to coaxially receive therein the forward end of an elongate stick element, said stick element having a rear butt end and a forward end and further having a longitudinal center line and an uppermost surface at its forward end defining a plane parallel to and spaced above said center line;

(B) a pair of side walls extending forwardly from said socket element and laterally divergently from said center line, said pair of side walls each having a forward end;

(C) a nose element bridging said forward ends of said side walls and traversing said center line:

(D) a rearwardly directed arcuate wall bridging said side walls and truncating the angle defined therebetween, said arcuate wall defining a ball stop, the combination of elements (A) through (D) defining a head frame having upper and lower rims, said upper rim defining the open mouth of the head frame and said lower rim having a plurality of apertures about its periphery for mounting of a netting thereacross to form a bottom closure of said head frame; and (E) means to cause the center of gravity of said head a frame to lie at an effective distance below said plane, whereby a player is enabled to sense orientation of said head frame through tactile stimuli generated by said head frame acting through a stick element whose forward end is mounted in said socket, said means comprising at least one of said side walls of said head frame being abruptly lowered to a spaced distance below said plane, said lowering being located along the length of said side wall and whereby an acutely depending step is defined therein.

7. The head frame of claim 6 wherein the center of gravity thereof lies at or below said center line.

8. The head frame of claim 6 wherein said abrupt lowering of said at least one side wall is located rearwardly of the mid-length thereof.

9. The head frame of claim 6 wherein each of said pair of side walls comprises said abrupt lowering thereof at a common location along the lengths thereof, thereby to define bilaterally symmetrical acutely depending steps therein.

10. The head frame of claim 9 wherein said abrupt lowering of said side walls is located rearwardly of said arcuate wall of (D).

11. The head frame of claim 6 wherein said nose element of (C) has upper and lower edges and wherein said nose element is canted forwardly and upwardly such the said upper edge is located forwardly of said lower edge.

* * * * *

UNITED STATES PATENT AND TRADEMARK OFFICE

CERTIFICATE OF CORRECTION

PATENT NO. : 5,651,549

DATED : July 29, 1997

INVENTOR(S) : James T. Dill, et al

It is certified that error appears in the above-identified patent and that said Letters Patent is hereby corrected as shown below:

On the title page, after "[22] Filed: Dec. 5, 1995" insert the following paragraph:

--Related U.S. Application Data

[63] Continuation of Ser. No. 342,344, November 18, 1994, abandoned. --.

Col. 1, l. 2, after the Title, insert the following paragraph:

-- This is a continuation of copending application Ser. No. 342,344, filed November 18, 1994, now abandoned. --.

Signed and Sealed this

Ninth Day of December, 1997

*Attest:*

*Attesting Officer*

BRUCE LEHMAN

*Commissioner of Patents and Trademarks*

US005651549B1

REEXAMINATION CERTIFICATE (3901st)

United States Patent [19] [11] B1 5,651,549

Dill et al. [45] Certificate Issued Oct. 12, 1999

[54] LACROSSE STICK AND HEAD FRAME THEREFOR

[75] Inventors: James T. Dill, Rockport, Me.; William H. Brine, III, Hopkinton, Mass.

[73] Assignee: Sports Licensing, Inc., Hanover, N.H.

Reexamination Request:
No. 90/005,231, Jan. 25, 1999

Reexamination Certificate for:

| | |
|---|---|
| Patent No.: | **5,651,549** |
| Issued: | **Jul. 29, 1997** |
| Appl. No.: | **08/567,600** |
| Filed: | **Dec. 5, 1995** |

Certificate of Correction issued Dec. 9, 1997.

[51] Int. Cl.[6] ..... A63B 59/02
[52] U.S. Cl. ..... 473/513
[58] Field of Search ..... 473/513

[56] References Cited

U.S. PATENT DOCUMENTS

| | | | |
|---|---|---|---|
| 3,545,755 | 12/1970 | Owada | 473/526 |
| 4,038,719 | 8/1977 | Bennett | 473/551 X |
| 4,147,348 | 4/1979 | Lee | 473/526 |
| 4,544,157 | 10/1985 | Curtis | 473/560 |
| 4,659,080 | 4/1987 | Stoller | 473/526 |

OTHER PUBLICATIONS

Committee Meeting Minutes of the United States Intercollegiate Association's Rules Committee, May 1983.
Lacrosse Magazine, Jun. 1994.

*Primary Examiner*—William H. Grieb

[57] ABSTRACT

Disclosed herein is a lacrosse stick construction and a head frame therefor having improved playability characteristics. The lacrosse stick involves a specified relationship between the plane defined by the uppermost surface of the stick element, taken at its forward end, relative to the location of the center of gravity of the head.

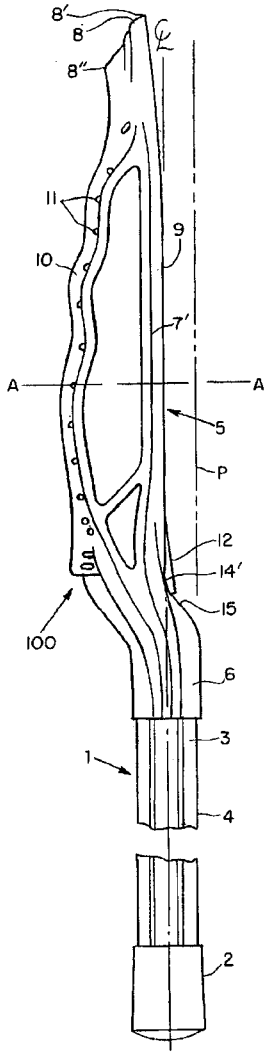

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *